US006130600A

United States Patent [19]

Wu

[11] Patent Number: 6,130,600

[45] Date of Patent: Oct. 10, 2000

[54] VARIABLE RESISTOR

[76] Inventor: Hui-Ming Wu, P.O. Box 82-144, Taipei, Taiwan

[21] Appl. No.: 09/409,234

[22] Filed: Sep. 30, 1999

Related U.S. Application Data

[63] Continuation-in-part of application No. 08/925,753, Sep. 9, 1997, abandoned.

[51] Int. Cl.[7] ..... H01C 10/30

[52] U.S. Cl. ..... 338/118; 338/176; 338/123; 338/125

[58] Field of Search ..... 338/160, 162, 338/176, 118, 120, 122, 123, 125, 127, 128

[56] References Cited

U.S. PATENT DOCUMENTS 4,223,294 9/1980 Moffitt et al. ..... 338/122
4,693,111 9/1987 Arnold et al. ..... 73/118.1
5,291,176 3/1994 Fujita ..... 338/125
5,673,015 9/1987 Arnold et al. ..... 338/132

*Primary Examiner*—Karl D. Easthom
*Attorney, Agent, or Firm*—A & J

[57] ABSTRACT

A variable resistor includes a circuit board having a conductive layer and a plurality of impedance layers arranged under the conductive layer, a slide having a metal contact plate movably mounted over the conductive layer and the impedance layers, wherein the impedance layers and the conductive layer have electric contacts respectively connected to circuit devices, output potentials at the electric contacts being relatively changed when the slide is moved with over the metal conductive layer and the impedance layers thereby controlling current flowing through the circuit devices.

1 Claim, 10 Drawing Sheets

VARIABLE RESISTOR

CROSS-REFERENCE

This application is a continuation-in-part of the U.S. patent application Ser. No. 08/925,753, Sep. 9, 1997 now abandoned.

BACKGROUND OF THE INVENTION

1. Field of the Invention

This invention is related to a variable resistor and in particular to one which can simultaneously control a plurality of circuit devices.

2. Description of the Prior Art

A variety of variable resistors have been disclosed for use in audio equipment and light fixtures for volume or light intensity control. Regular variable resistors for these purposes commonly comprise a substrate, a set of impedance layers mounted on the substrate, and a slide connected to power supply and slidably mounted on the substrate. When the slide is moved on the substrate, the output impedance value is relatively changed, and the output potential of the circuit device(s) connected thereto is relatively controlled. The drawback of these variable resistors is that they provide only one variation (i.e., they control the output potential of the connected circuit devices synchronously). Therefore, several variable resistors must be installed when to separately control a plurality of circuit devices, for example, different stage lighting fixtures). However, the control unit becomes huge when several variable resistors are installed in it.

Therefore, it is an object of the present invention to provide an improved variable resistor which can obviate and mitigate the above-mentioned drawbacks.

SUMMARY OF THE INVENTION

This invention is related to a variable resistor and in particular to one which can simultaneously control a plurality of circuit devices.

According to a preferred embodiment of the present invention, a variable resistor comprising a circuit board having a conductive layer and a plurality of impedance layers arranged in under the conductive layer, a slide having a metal contact plate movably mounted over said conductive layer and said impedance layers, wherein said impedance layers and said conductive layer have electric contacts respectively connected to circuit devices, output potentials at said electric contacts being relatively changed when said slide is moved with over said metal conductive layer and said impedance layers thereby controlling current flowing through said circuit devices.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
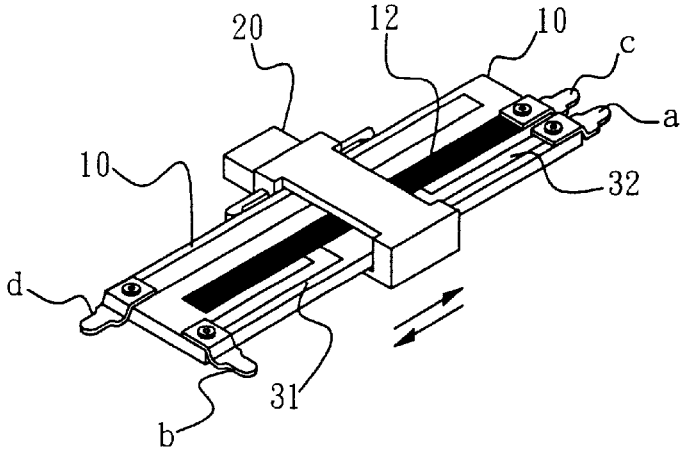
FIG. 1 is a perspective view of a first preferred embodiment according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
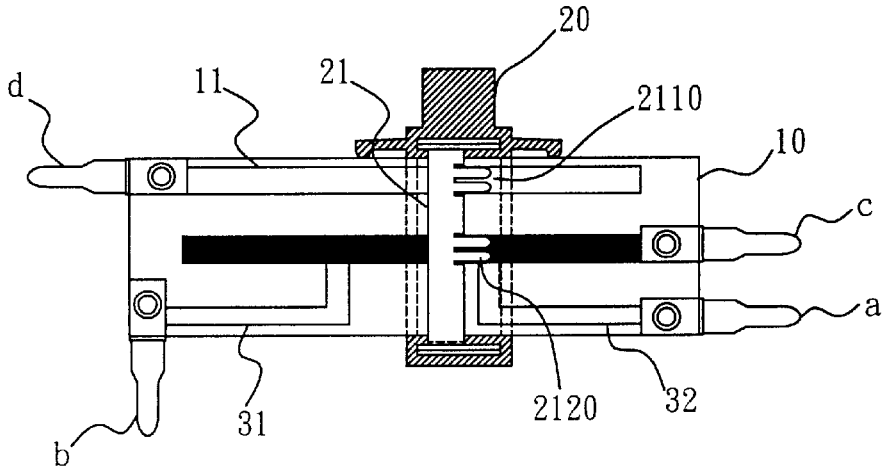
FIG. 2 is a sectional view of the first preferred embodiment.

With reference to the drawings and in particular to FIGS. 1 and 2 thereof, the variable resistor according to the present invention generally comprises a rectangular circuit board 10 and a hollow slide 20 slidably mounted on the circuit board 10.

The rectangular circuit board 10 has one side provided with an elongated conductive layer 11, and an elongated impedance layer 12 (generally made of carbon film) arranged adjacent the conductive layer 11. An end of the conductive layer 11 is connected to a first metal contact (d) at one end of the circuit board 10. Two ends of the impedance layer 12 are connected to two fourth and second metal contacts (c) and (c'), respectively, at two ends of the circuit board 10. The impedance layer 12 is connected to a third metal contact (b) at one end of the circuit board 10 via a conductor 31, and to a fifth metal contact (a) at another end of the circuit board 10 via a conductor 32. The contacts (a), (b) and (c) are for connecting different lamps LA, LB and LC (see FIG. 4) with different colors (or an electrical circuit for lamps). The contact (d) is designed for connecting an electrode of a power source.

The hollow slide 20 comprises a base frame sleeved onto the circuit board 10 and a metal contact plate 21 mounted within the base frame. The metal contact plate 21 comprises two first contact legs 2110 disposed in contact with the conductive layer 11 and two second contact legs 2120 disposed in contact with the impedance layer 12.

Figure 3:
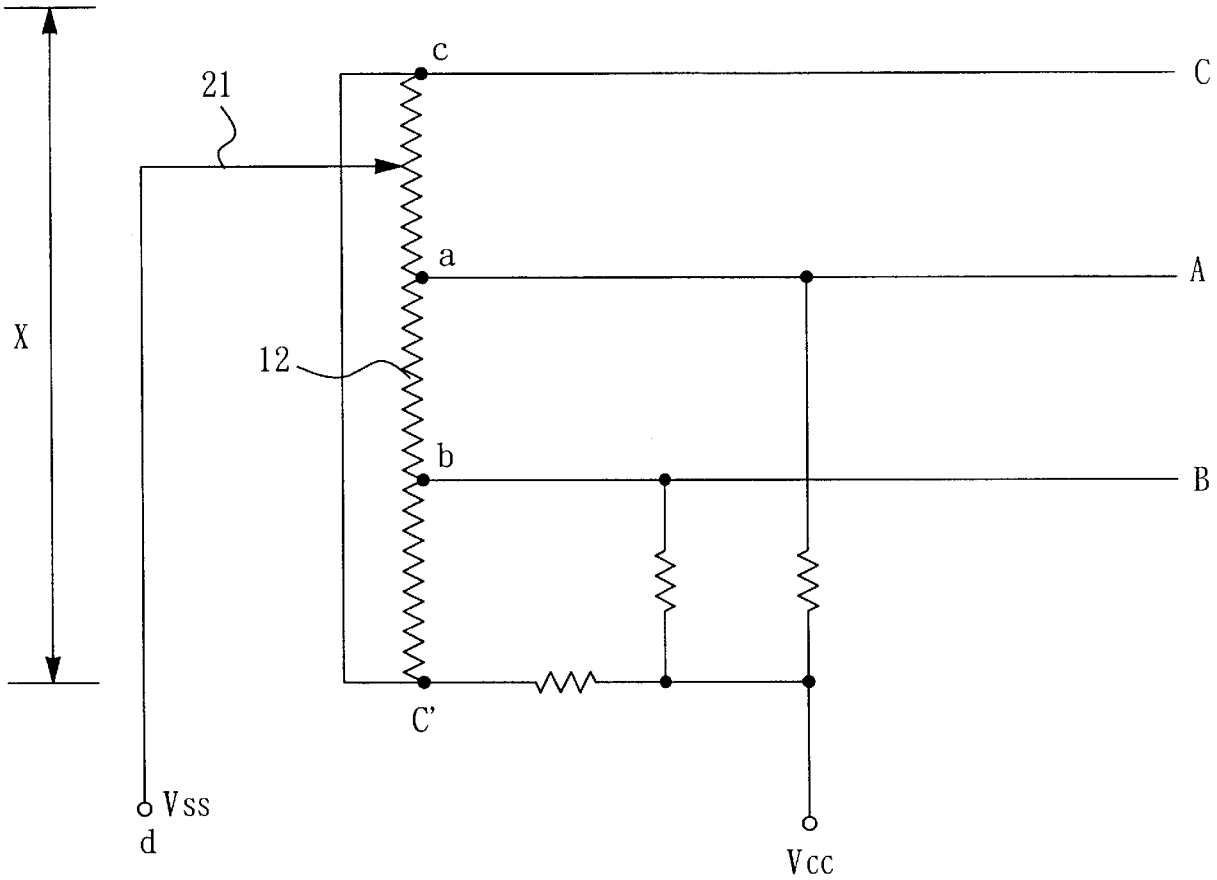
FIG. 3 is a circuit diagram of the first preferred embodiment.
Figure 4:
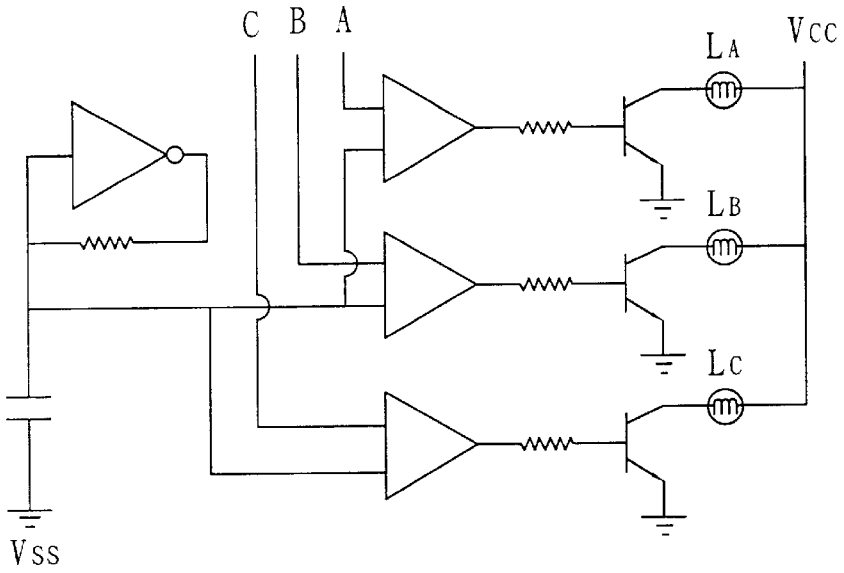
FIG. 4 is a working diagram of the first embodiment.
Figure 8:
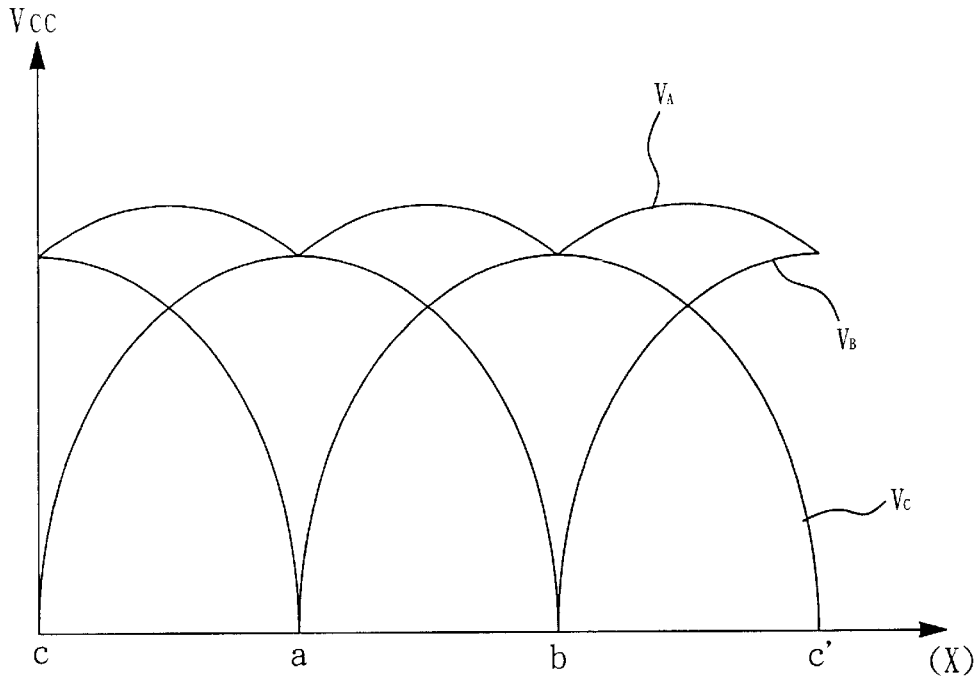
FIG. 8 is a diagram illustrating the output potential curves of the first preferred embodiment.

Referring to FIGS. 3 and 4, the moving range of the metal contact plate 21 of the slide 20 is represented by X and the contacts (a), (b) and (c) are connected to three lamps (not shown) of different colors (or the electrical circuit of the lamps). The currents at the outputs A, B and C flow through the metal contact plate 21 of the slide 20 to the conductive layer 11 and the impedance layer 12 thereby forming a complete circuitry. As the metal contact plate 21 is moved, the resistance between the contacts (a), (b) and (c) and the metal contact plate 21 will be changed thereby changing the output potential at the outputs A, B and C. Referring to FIGS. 2 and 8, when the metal contact plate 21 is moved from the contact (c) toward the contact (b), the resistance between the contact (c) and the metal contact plate 21 will be gradually increased, but the resistance between the contact (a) and the metal contact plate 21 will be gradually decreased. As the metal contact plate 21 reaches the contact (a) via the conductor 32, the resistance between the contact (a) and the metal contact plate 21 will become zero.

When the slide 20 is moved away from the contact (a), the resistance between the contact (a) and the metal contact plate 21 will be gradually increased, but the resistance between the contact (b) and the metal contact plate 21 will be gradually decreased. When the metal contact plate 21 reaches the contact (b), the resistance between the contact (b) and the metal contact plate 21 will become zero.

Consequently, the resistance at the outputs A, B and C will be changed with the position of the metal contact plate 21 thereby enabling the present invention to change the resistance to control the output potentials VA, VB and VC.

Figure 5:
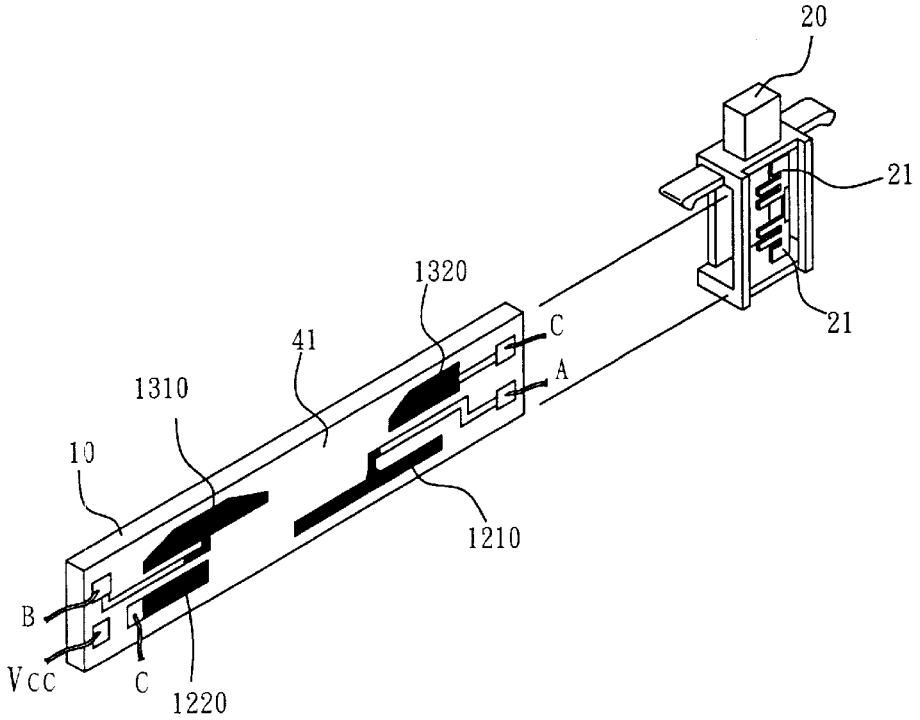
FIG. 5 illustrates a second preferred embodiment of the present invention.
Figure 6:
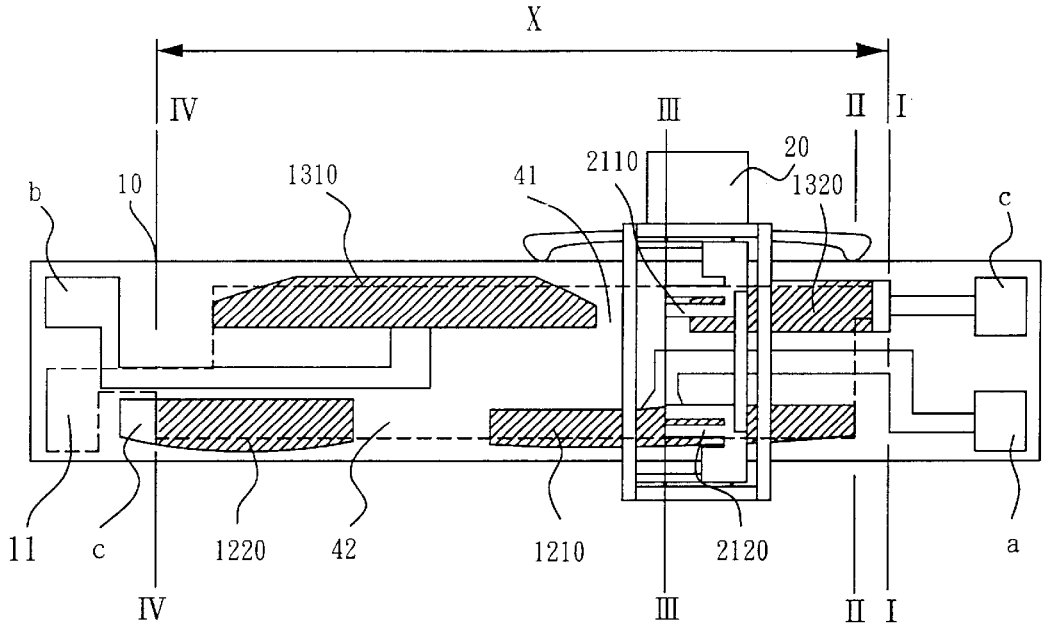
FIG. 6 illustrates the structure of the second preferred embodiment.

FIGS. 5 and 6 illustrate a second preferred embodiment of the present invention. As shown, the rectangular circuit board 10 is provided with a conductive layer 11 at its backside and two impedance layers at front side. The lower impedance layer is divided by a gap 42 into two impedance sections 1210 and 1220 and the upper impedance layer is divided by a gap 41 into two impedance sections 1310 and 1320. A slide 20 having a base frame is sleeved onto the circuit board 10 and electrically connected with the conductive layer 11 of the circuit board 10. Further, the slide 20 has a metal contact plate 21 mounted within the base frame. The metal contact plate 21 comprises two first contact legs 2110 adapted to be in contact with the impedance sections 1210 and 1220, and tvo second contact legs 2120 to be in contact with the impedance sections 1310 and 1320.

Figure 7:
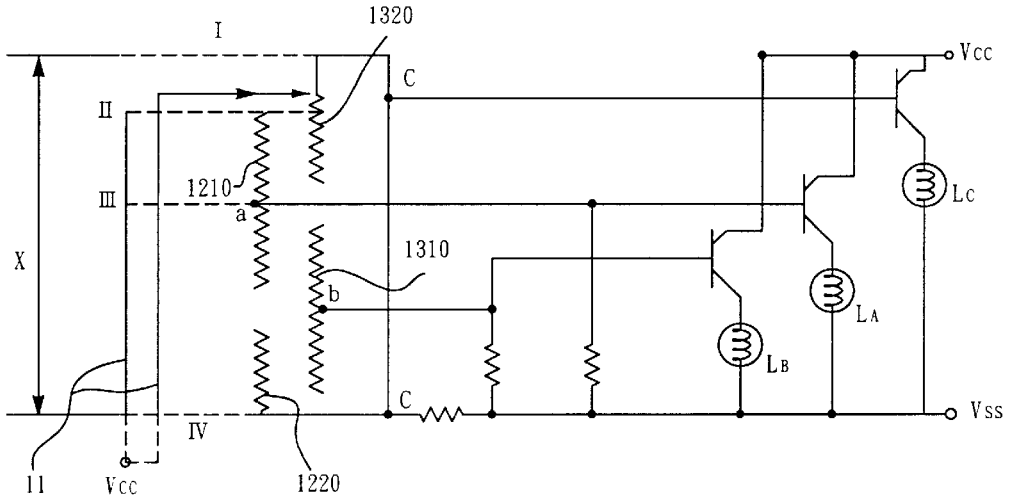
FIG. 7 is a circuit diagram of the second preferred embodiment.
Figure 9:
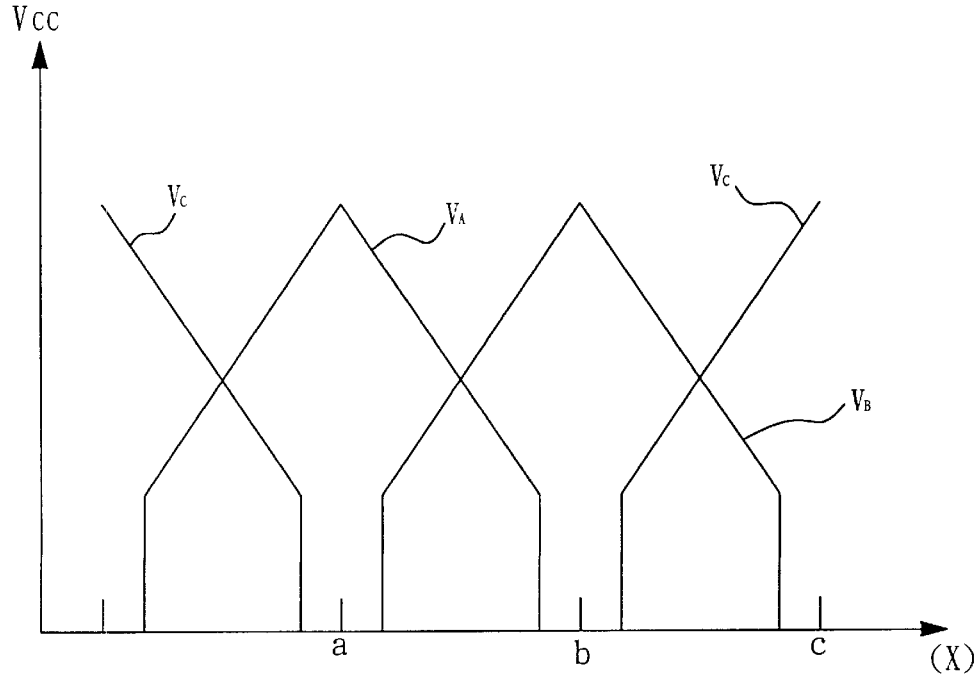
FIG. 9 is a diagram illustrating the output potential curves of the second preferred embodiment.

The working principle of the second preferred embodiment is illustrated in FIGS. 6, 7 and 9. As shown, the intermediate portion of the impedance section 1210 is connected to a contact (a) via a conductor (shown but not numbered), the impedance section 1220 is connected to a contact (c'), the intermediate portion of the impedance section 1310 is connected to a contact (b) via a conductor (shown but not numbered), and the impedance section 1320 is connected to a contact (c). The contacts (a), (b) and (c) are connected to lamps LA, LB and LC of different colors. As the metal contact plate 21 is located at the position shown by line I—I where the slide 20 is not in contact with the conductive layer 11, the circuitry will become open. When the slide 20 is moved to the position shown by line II—II so that the metal contact plate 21 is in contact with the impedance layer 1320, the resistance between the metal contact plate 21 and the contact (c) will be minimum thereby providing the maximum output potential for the lamp LC. As the metal contact plate 21 is further moved to the left (with respect to FIG. 6) to be in contact with the impedance sections 1210 and 1320, the resistance between the contact (c) and the metal contact plate 21 will be increased. When the metal contact plate 21 is further moved to the position shown by line III—III so that the first contact legs 2110 of the metal contact plate 21 are in contact with the intermediate portion of the impedance section 1210 (i.e. the contact (a)), the resistance to the lamp LA will be the minimum. Meanwhile, the second contact legs 2120 of the metal contact plate 21 are located at the gap 41 and the contacts (c) and (b) are open. As the metal contact plate 21 is further moved to the left so that the first and second contact legs 2110 and 2120 are in contact with the impedance sections 1210 and 1310 respectively, the resistance between the contact (a) and the metal contact plate 21 will be increased while the resistance between the contact (b) and the metal contact plate 21 will be decreased. When the metal contact plate 21 is further moved to the position shown by line IV—IV so that the first contact legs 2110 are located at the gap 42 and the second contact legs 2120 are in contact with the intermediate portion of the impedance section 1310 (i.e. the contact (b)), the resistance between the metal contact plate 21 and the contact (b) is zero thereby providing the maximum output potential for the lamp LB. As the metal contact plate 21 is further moved to the left, the resistance between the metal contact plate 21 and the contact (c') will be decreased thereby providing the maximum potential for the lamp LC.

Figure 10:
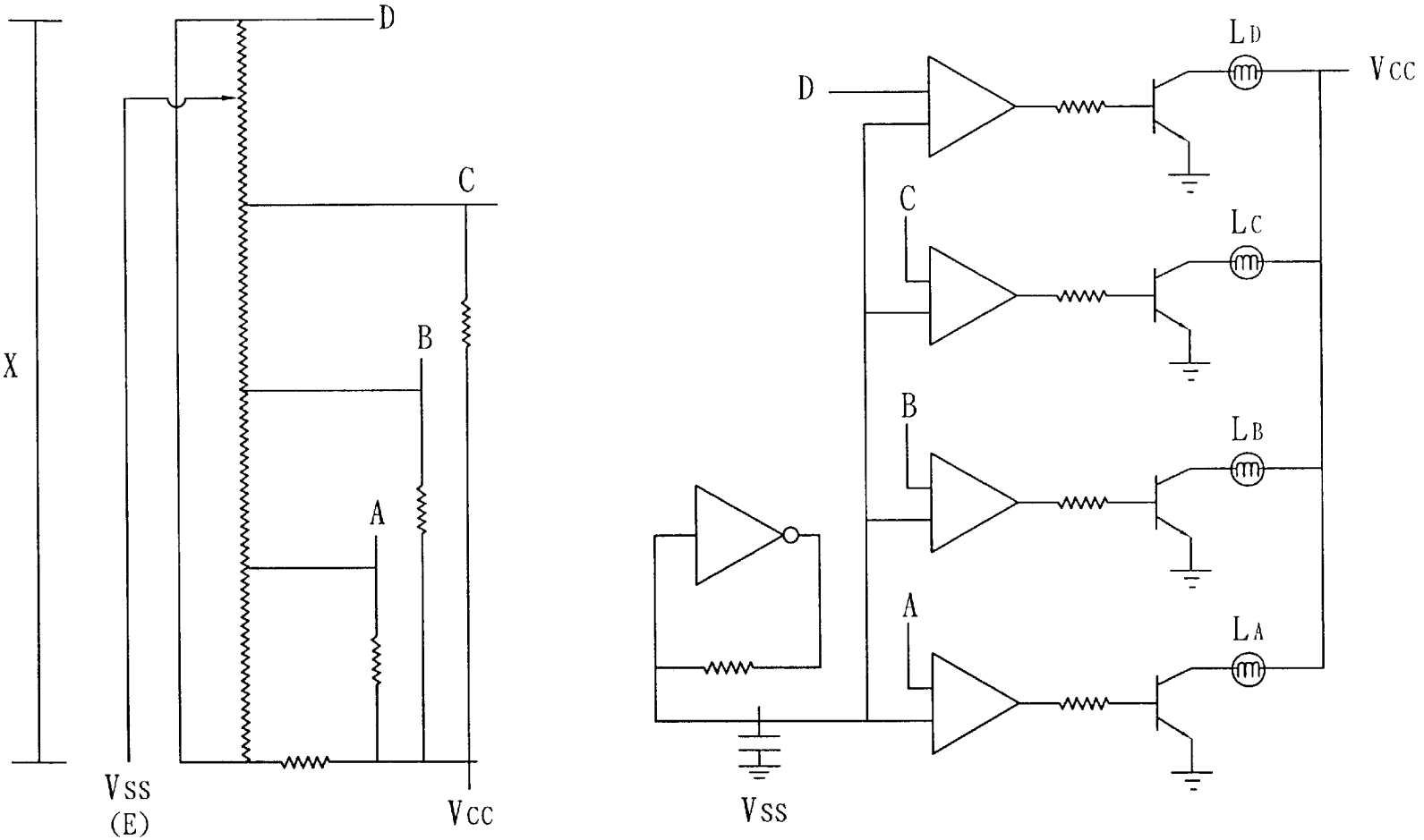
FIG. 10 is an alternative circuit diagram of the first preferred embodiment.
Figure 11:
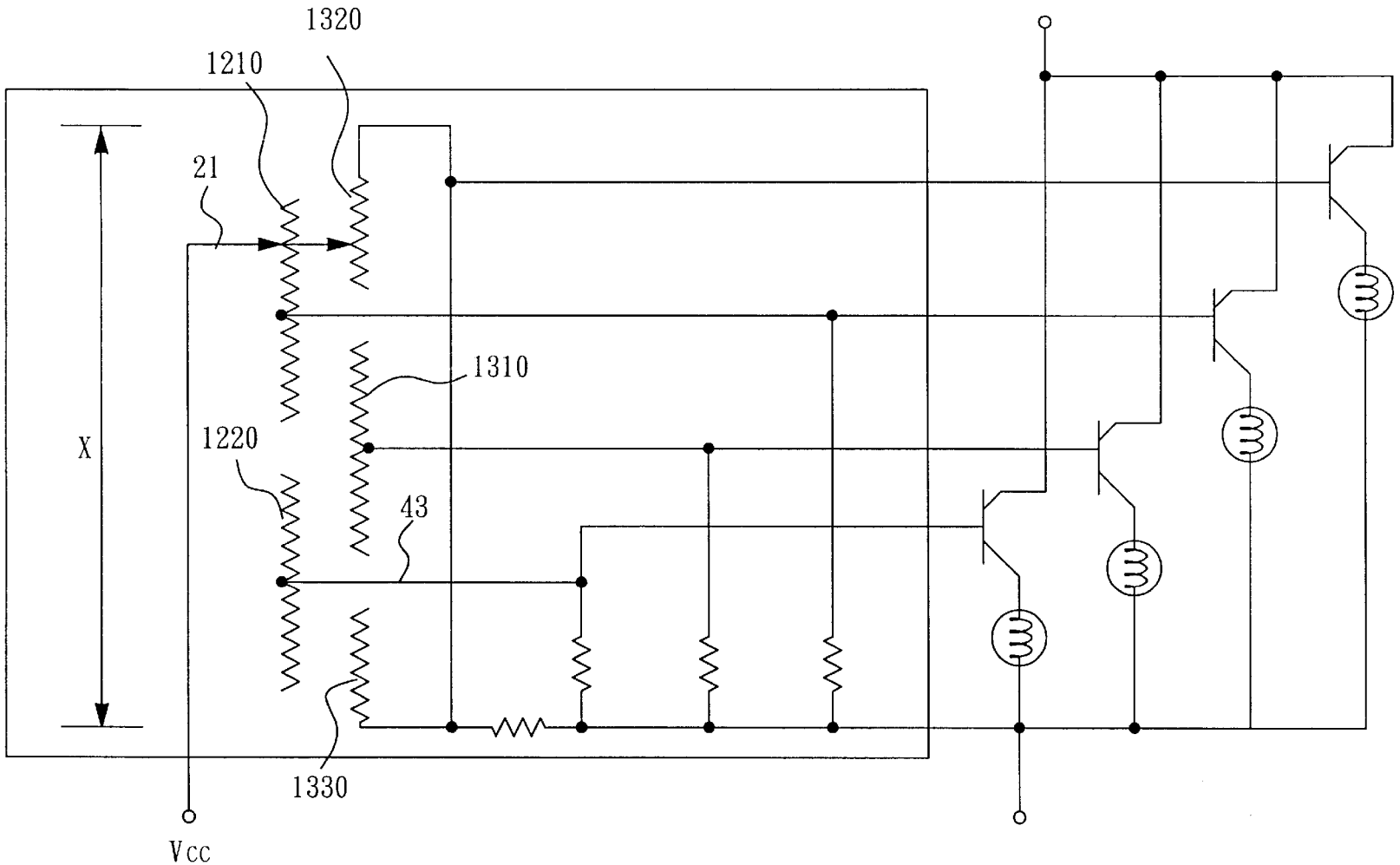
FIG. 11 is an alternative circuit diagram of the second preferred embodiment.
Figure 12:
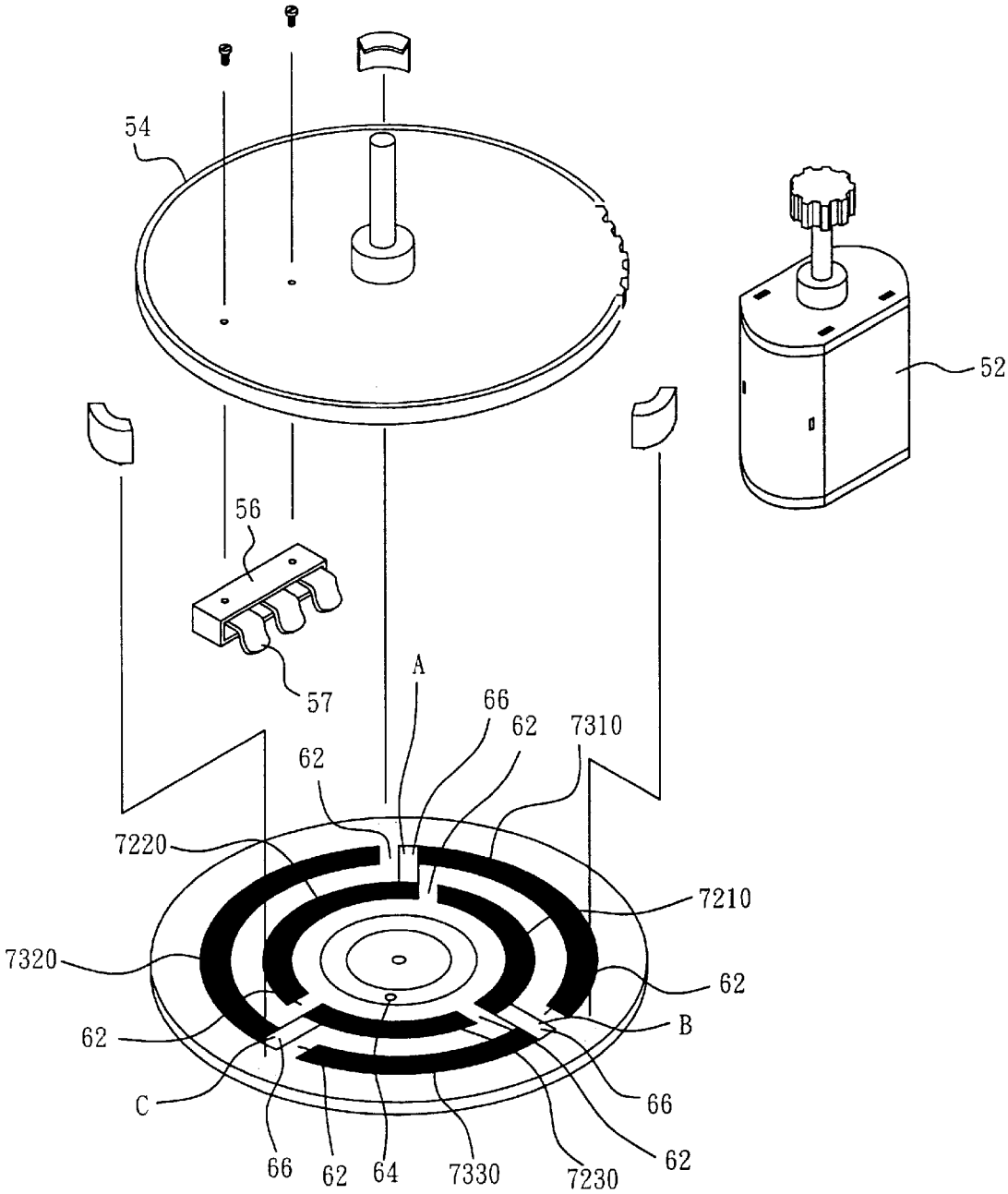
FIG. 12 is an exploded view of a third preferred embodiment according to the present invention.
Figure 13:
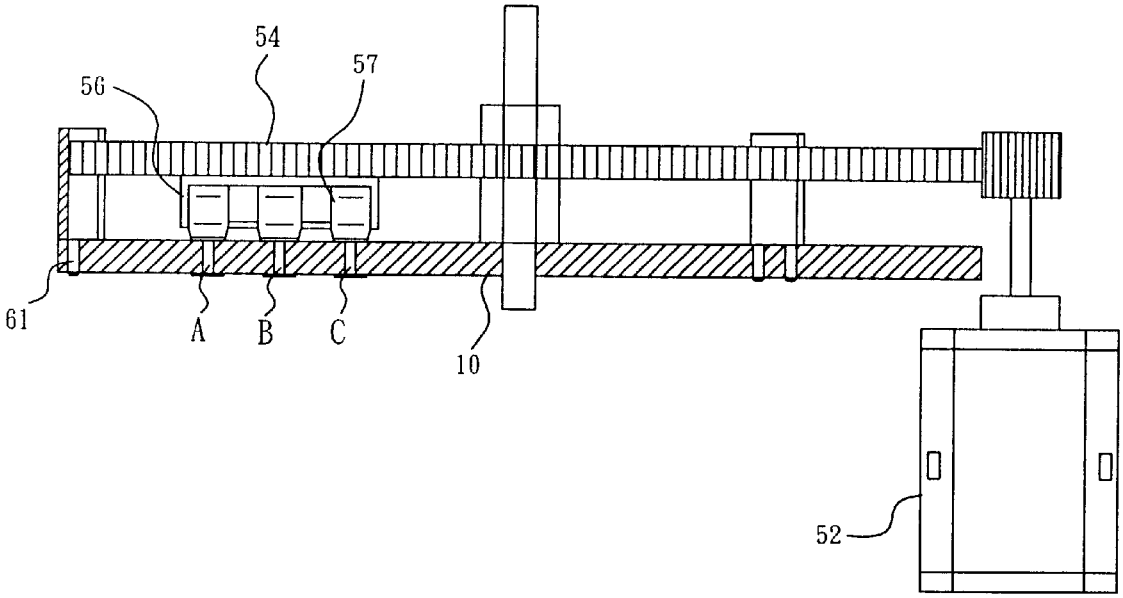
FIG. 13 is a sectional view of the third preferred embodiment.
Figure 14:
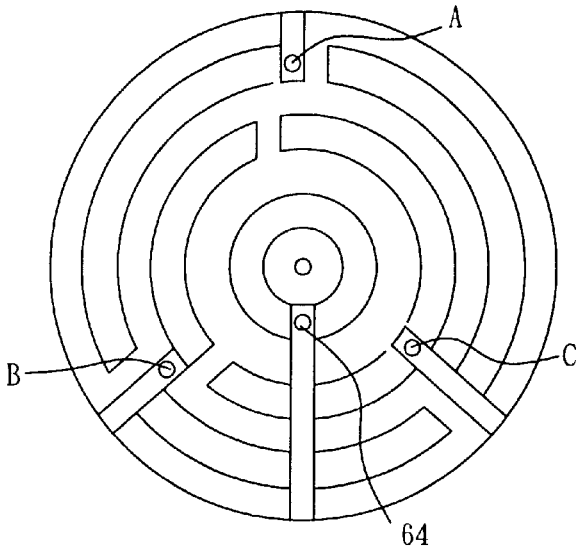
FIG. 14 illustrates the backside of the circular circuit board of the third preferred embodiment.
Figure 15:
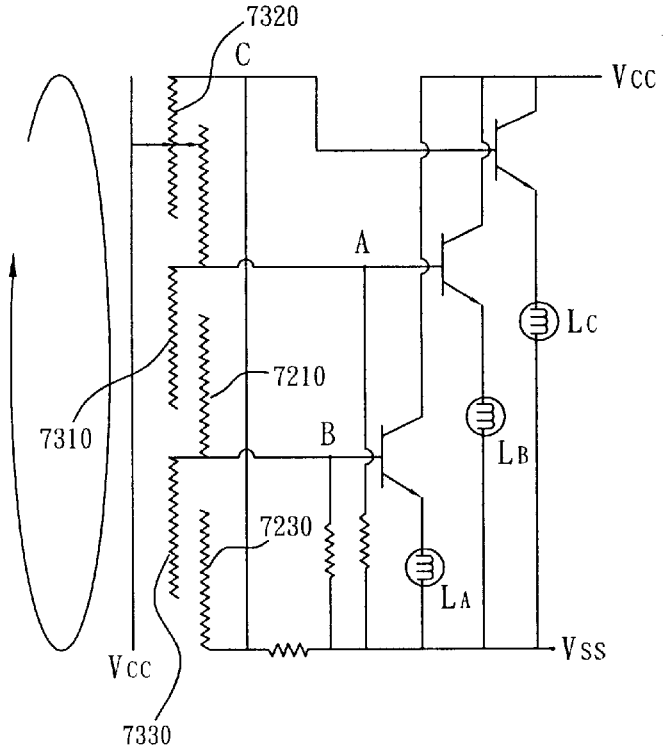
FIG. 15 is a circuit diagram of the third preferred embodiment.
Figure 16:
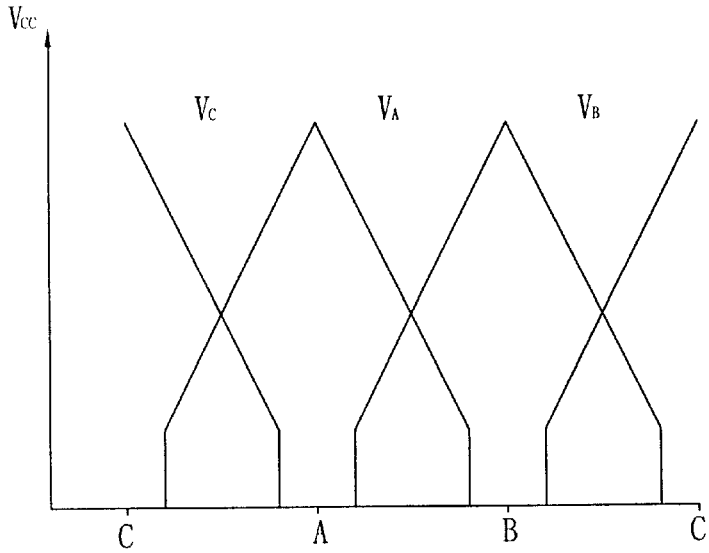
FIG. 16 is a diagram illustrating the output potential curves of the third preferred embodiment.

The present invention utilizes a number of impedance layers or the gaps between the impedance layers to control a plurality of lamps. As shown in FIG. 10, a control circuit may be directly connected to any desired point on the impedance layer if the impedance layer is not divided by gap(s). Referring to FIG. 11, when desired to increase the number of lamps to be controlled, an impedance layer 1330 forming a circuit with another end of the original impedance may be directly added to the original impedance layer (i.e. increasing a gap 43 on the impedance layer).

FIGS. 12, 13, 14, 15 and 16 illustrate another preferred embodiment of the present invention. As shown, the variable resistor comprises a circular circuit board provided with outputs A, B and C and utilizes a motor 52 to drive a rotating disc 54. A slide 56 is mounted under the rotating disc 54 and has contact legs 57 adapted to be in contact with the impedance layers 7210, 7220, 7230, 7310, 7320 and 7330 which are separated by gaps 62.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

What is claimed is:

1. A variable resistor comprising:

a circuit board having one side provided with an elongated conductive layer and an elongated impedance layer arranged adjacent said conductive layer, said one side of said circuit board having an end provided with a first metal contact, a second metal contact and a third metal contact and having another end provided with a fourth metal contact and a fifth metal contact, an end of said elongated conductive layer being connected to said first metal contact, two ends of said elongated impedance layer being connected to said second and said fourth metal contacts, said elongated impedance layer being connected to said third metal contact via a first conductor and said fifth metal contact via a second conductor, said third, fourth and fifth metal contacts being respectively connectable to circuit devices, said first metal contact being connectable to an electrode of a power source; and a slide having a metal contact plate movably mounted over said elongated conductive layer and said elongated impedance layer, wherein said elongated impedance layers and said elongated conductive layer have, output potentials at said electric contacts being relatively changed when said slide is moved over said elongated conductive layer and said elongated impedance layer thereby controlling current flowing through the circuit devices.

* * * * *